United States Patent [19]

Bisher

[11] Patent Number: 4,958,869

[45] Date of Patent: Sep. 25, 1990

[54] SECURITY STOP

[76] Inventor: Dwight S. Bisher, 5106 Wadena Ct., Greensboro, N.C. 27407

[21] Appl. No.: 467,553

[22] Filed: Jan. 19, 1990

[51] Int. Cl.[5] ..... E05C 17/54

[52] U.S. Cl. ..... 292/339; 292/343

[58] Field of Search ..... 292/DIG. 15, 339, 288, 292/342, 343; 16/86 R, 86 A, 86 B, 86 C

[56] References Cited

U.S. PATENT DOCUMENTS

| | | | |
|---|---|---|---|
| 182,883 | 10/1876 | Ball | 292/339 |
| 521,037 | 6/1894 | McCombs | 292/343 |
| 550,264 | 11/1895 | Flesch | 292/343 |
| 559,382 | 5/1896 | Hoffman | 292/339 |
| 693,740 | 2/1902 | Raether | 292/343 |
| 1,042,329 | 10/1912 | Daniels | 292/343 |
| 1,246,707 | 11/1917 | Boynton | 292/339 |
| 1,545,532 | 7/1925 | Stubbs | 292/343 |
| 1,681,834 | 8/1928 | Arends | 292/DIG. 15 |
| 2,647,782 | 8/1953 | Fisk | 292/343 |
| 4,142,752 | 3/1979 | Chilton | 292/343 |

FOREIGN PATENT DOCUMENTS

| | | | |
|---|---|---|---|
| 390291 | 12/1922 | Fed. Rep. of Germany | 292/343 |
| 379273 | 8/1923 | Fed. Rep. of Germany | 292/339 |
| 584344 | 8/1933 | Fed. Rep. of Germany | 292/343 |

*Primary Examiner*—Eric K. Nicholson

[57] ABSTRACT

A security stop for a door or the like is provided which will prevent the door from opening inward by unauthorized persons. The device can be easily set between the door and the threshold and can be easily removed and stored for transportation purposes. The device comprises a wedge-shaped member which is forced underneath the door and includes an inverted V-shaped frame which acts as a brace to assist in holding the wedge-shaped member.

6 Claims, 2 Drawing Sheets

SECURITY STOP

BACKGROUND OF THE INVENTION

1. Field Of The Invention

The present invention pertains to devices for use with doors to prevent unauthorized entry and particularly pertains to portable means to secure a door for use in motels, hotels and the like.

2. Description Of The Prior Art And Objectives Of The Invention

Various devices have been employed in the past to provide security in addition to conventional door locks for motel and hotel patrons. Such devices can be used by guests, once they have settled in their rooms at night, to prevent maids or other persons with keys from inadvertently opening the door and entering the occupied room. Such devices may consist of chairs with proper sized backs which are wedged under the inside door knob to prevent entry. The availability of such chairs is not always certain and the present invention was conceived with the objection of providing a traveler or other security minded person with a convenient, easy to use security door stop.

It is also an objective of the invention to provide the user with a means to secure an inwardly opening door which can be quickly employed.and in the event of an emergency, can be quickly removed from the door without keys or special tools.

It is still another objective of the present invention to provide a security stop which will readily prevent unauthorized entry when in place, even if the door is unlocked.

It is yet another objective of the present invention to provide a device which is durable, simple in construction, easy to manufacture, transport and store, and which can be retailed at a relatively inexpensive price.

Various other objectives and advantages of the present invention become apparent to those skilled in the art as a more detailed presentation of the invention is within the detailed presentation of the invention set forth below.

SUMMARY OF THE INVENTION

The aforesaid and other objectives are realized by providing a door stop which includes a wedge-shaped member which is rotatable on and tightenable to an inverted V-shaped frame. The "legs" of the frame are pivotally joined and adjustably positionable whereby the wedge-shaped member can be placed at the bottom of the door between the door and the threshold and the rear leg of the inverted V-shaped frame placed on the floor to hold the wedge-shaped member within the opening beneath the door. The front and rear leg of the inverted V-shaped frame includes a friction producing surface as does the bottom of the wedge-shaped member to provide further resistance in the event the door is attempted to be opened by forcing it inwardly.

DESCRIPTION OF THE PREFERRED EMBODIMENT

Figure 1:
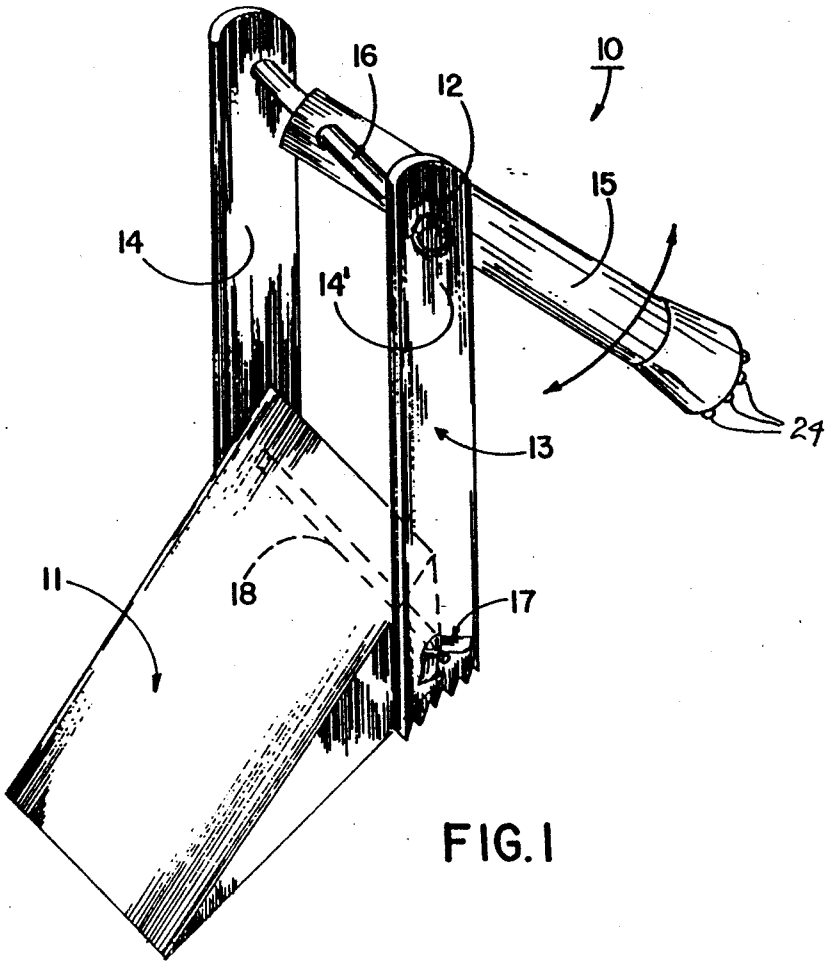
FIG. 1 demonstrates a perspective view of the invention.
Figure 3:
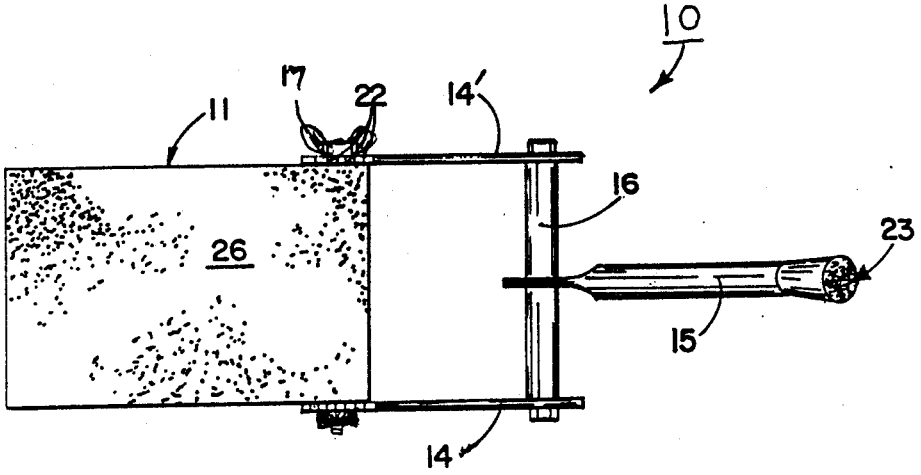
FIG. 3 illustrates a bottom view of the security stop as shown in FIG. 1.

The preferred form of the invention is shown in FIG. 1 and includes a wedge-shaped member formed from a durable, rigid plastic. The wedge-shaped member is rotatably attached to an inverted V-shaped frame and the rear leg of the inverted V-shaped frame includes gripper teeth along the bottom thereof. The front leg of the V-shaped frame comprises two parallel members which are attached at their upper ends to an axle and are joined on either side of the wedge-shaped member. A wing nut is tightenable on a bolt passing through the wedge-shaped member for adjusting the angle at which the wedge-shaped member and front leg of the inverted V-shaped frame are configured. The frame axle allows rotation between the longitudinal second leg and the first leg of the inverted V-shaped frame. As seen in FIG. 3, the wedge-shaped member has a bottom gripping surface which may consists of an abrasive layer and the second or rear leg has a gripping surface comprising a series of flexible teeth. The parallel members of the first leg also include pointed gripper teeth for grasping a carpet or the like as may be found in hotel rooms.

DETAILED DESCRIPTION OF THE DRAWINGS AND OPERATION OF THE INVENTION

Security stop 10 as shown in FIG. 1 includes wedge-shaped member 11 and inverted V-shaped frame 12 which consists of front leg 13 and rear leg 15. Front leg 13 includes two parallel members 14, 14' which are rotatably attached to wedge-shaped member 11 by pivot rod 18 which passes through a channel in wedge-shaped member 11. Front leg 13 of inverted V-shaped member 12 is adjustably tightenable to wedge-shaped member 11 by wing nut 17. Also seen in FIG. 1. is rear leg 15 which is rotatably joined to front leg 13 by axle 16.

Figure 2:
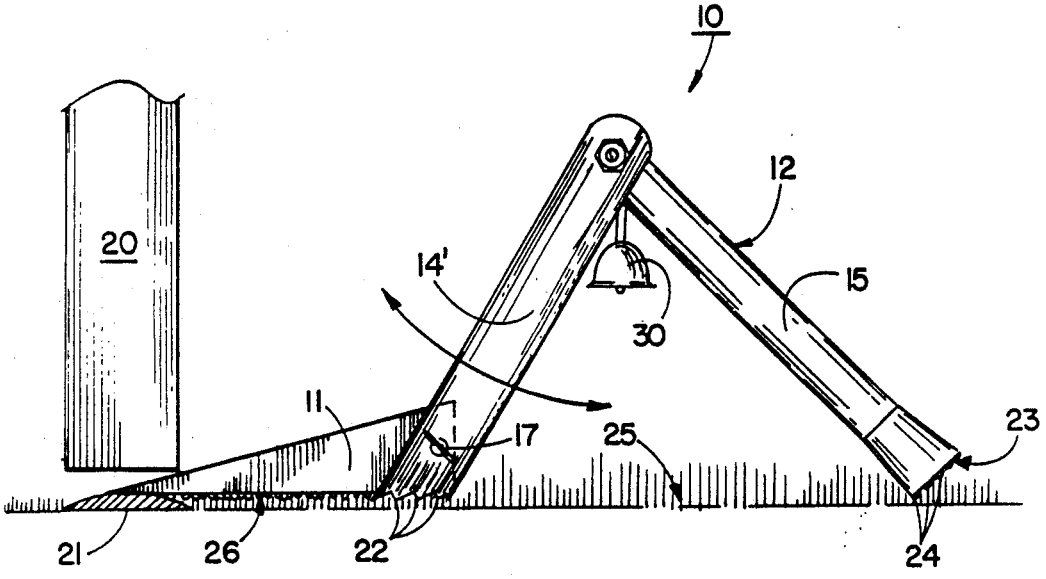
Fig. 2 shows a modification of the security stop in place under a door.

A modification of the invention is shown in FIG. 2 whereby security stop 10 is positioned under door 20 and on top of threshold plate 21. Frame 12 thereby acts as a brace for wedge-shaped member 11 as gripper teeth 22 of parallel members 14, 14' contact floor 25 which may be for example, covered with carpet, vinyl tile or other materials. As further shown in FIG. 2, rear leg 15 also has a gripper surface 23 comprising a series of teeth 24. The bottom gripping surface 26 of wedge-shaped member 11 also has a friction producing surface formed from an abrasive-like material attached thereto.

In use, wedge-shaped member 11 is manually forced between door 20 and threshold plate 21. Next, front leg 13 is adjusted with gripper teeth 22 contacting floor surface 25. Wing nut 17 is then tightened and lastly, rear leg 15 is rotated into firm engagement with gripper teeth 24 in firm contact with floor surface 25. With security stop 10 so positioned door 20 cannot be swung inwardly, towards security stop 10. A means to signal the room occupant is also shown in FIG. 2 in the form of a bell 30 which would ring to alert the occupant. Various other types of signaling devices such as electronic whistles or lights could similarly be employed.

In FIG. 3, gripping surface 26 is shown on the bottom of wedge-shaped member 11. Security stop 10 as shown therein is constructed from a relatively rigid plastic although it may be made from aluminum or other components as suitable and available.

The illustrations and examples provided herein are for explanatory purposes and are not intended to limit the scope of the appended claims.

I claim:

1. A security stop comprising: a wedge-shaped base, said base having an uneven friction producing surface, a pivotable frame, said frame comprising a pair of parallel members and a longitudinal member, said parallel members each having first and second ends, said first ends comprising gripper teeth, said longitudinal member and said base pivotally joined between said pair of parallel members at opposite ends thereof, whereby said wedge-shaped base can be placed at the bottom of a door between the door and the threshold with the longitudinal member contacting the floor to thereby prevent opening of the door.

2. A security stop as claimed in claim 1 wherein said base is adjustably affixed to said frame.

3. A security stop as claimed in claim 1 wherein said wedge-shaped base has an abrasive bottom surface.

4. A security stop as claimed in claim 1 wherein said longitudinal member comprises gripper teeth.

5. A security stop for a door to prevent unauthorized entry comprising: a wedge-shaped base, said base having a rough friction producing surface, a frame, said base rotatably joined to said frame, said frame comprising first and second legs, said legs pivotally joined to each other, said first leg comprising a pair of parallel members, said parallel members each having first and second ends, said first ends having gripper teeth, said second leg comprising a longitudinal member, said base positioned between said parallel members and releasably tightenable therebetween, said second leg comprising a gripper surface, whereby said wedge-shaped base can be placed under a door and tightened to said frame, and said frame placed against the floor to brace the wedge-shaped member to thereby prevent the door from being opened.

6. A security stop for a door comprising: a wedge-shaped base, said base having an abrasive bottom surface, a frame, said frame comprising first and second legs, said first leg comprising a pair of parallel members, said parallel members each having first and second ends, said base pivotally joined between first ends of said parallel members, said second leg comprising a longitudinal member, said longitudinal member having a forward and a rear end, said forward end of said longitudinal member pivotally joined between said second ends of said parallel members, said first ends each having gripper teeth, said rear end of said longitudinal member having gripper teeth, said parallel members adjustably tightenable to said base whereby said base can be positioned beneath a door and tightened within said parallel members to prevent unauthorized entry through said door.

* * * * *